US008480145B2

(12) United States Patent
Eastall

(10) Patent No.: US 8,480,145 B2
(45) Date of Patent: Jul. 9, 2013

(54) VERTICAL BORE COIL LIFTING APPARATUS

(75) Inventor: Jonathan F. Eastall, Indooroopilly (AU)

(73) Assignee: Eastall Precision Engineering Pty Ltd., Coopers Plains (AU)

( * ) Notice: Subject to any disclaimer, the term of this patent is extended or adjusted under 35 U.S.C. 154(b) by 0 days.

(21) Appl. No.: 13/269,673

(22) Filed: Oct. 10, 2011

(65) Prior Publication Data

US 2013/0088027 A1 Apr. 11, 2013

(51) Int. Cl.
*B66C 1/28* (2006.01)
*B66C 1/54* (2006.01)

(52) U.S. Cl.
USPC ..... 294/110.1; 294/67.31; 294/97; 294/112; 414/911

(58) Field of Classification Search
USPC ..... 294/103.2, 67.1, 67.31, 86.12, 97, 294/98, 110.1, 110.2, 112, 117; 414/426, 414/429, 911
See application file for complete search history.

(56) References Cited

U.S. PATENT DOCUMENTS

| | | | | |
|---|---|---|---|---|
| 2,076,494 | A * | 4/1937 | Camerota et al. | 294/87.1 |
| 2,670,233 | A * | 2/1954 | Barchoff | 294/97 |
| 2,706,658 | A * | 4/1955 | Jewell | 294/97 |
| 2,803,489 | A * | 8/1957 | Zito et al. | 294/103.2 |
| 3,086,808 | A * | 4/1963 | Kaplan | 294/67.31 |
| 3,297,353 | A * | 1/1967 | Carlson | 294/81.61 |
| 3,298,730 | A | 1/1967 | Soley | |
| 3,680,907 | A * | 8/1972 | Siegwart | 294/103.2 |
| 4,253,696 | A * | 3/1981 | Bradley | 294/103.2 |
| 6,817,826 | B2 * | 11/2004 | Bullington et al. | 414/621 |
| 2004/0161324 | A1 | 8/2004 | Figiel et al. | |

FOREIGN PATENT DOCUMENTS

DE 10 2005 022 058 1/2006

* cited by examiner

*Primary Examiner* — Dean Kramer
(74) *Attorney, Agent, or Firm* — Bay State IP, LLC

(57) ABSTRACT

A vertical bore coil lifter for lifting coils of steel with reduced risk of the coil telescoping includes a pair of inside legs dimensioned to fit inside the bore of the coil with remote legs to support inner wraps of the bottom of the coil. Opposed outer legs traverse the outside of the coil and terminate in outer legs that oppose the inner legs. The outer legs supporting outer wraps of the coil and prevent telescoping of the coil while it is being lifted. The lifter may be selectively brought from an open configuration, in which the feet are drawn apart to release or receive a coil to a closed configuration in which the opposed feet are drawn together to cooperate in supporting the underside of the coil. In one embodiment an automatic latching and unlatching mechanism is provided to alternate between the release and closed configurations without need for operator intervention.

13 Claims, 10 Drawing Sheets

A-A(1:2)

VERTICAL BORE COIL LIFTING APPARATUS

TECHNICAL FIELD

The present invention relates to a vertical bore coil lifter. A vertical bore coil lifter according to the invention may particularly find application where coils of rolled steel need to be transported from one location to another.

BACKGROUND

Any references to methods, apparatus or documents of the prior art are not to be taken as constituting any evidence or admission that they formed, or form part of the common general knowledge.

It is known to provide steel in coils. Such coils are formed around a central bore. The coils are typically stored on palettes with the bores vertical. A circumferential steel strap and usually four radial coil straps are provided to ensure the integrity of the coil as it is handled. The mechanical properties of such coils are explained in the paper *Lifting of Steel coils in Bore-Vertical Orientation*, by C. V. Tu and W. Y. D. Yen, presented at the $5^{th}$ Australasian Congress on Applied Mechanics (ACAM 2007 10-12 Dec. 2007, Brisbane, Australia). As explained in that paper, such coils are usually handled by a lifting device that includes a mechanism to allow lifting feet to penetrate the bore and extend outwards under the inner wraps of the coil before lifting. However, coil telescoping has been known to occur during such lifting whereby the coil straps break so that the coil suddenly unwraps itself in an elevated position.

It will be realized that such coil telescoping presents a dangerous situation to workers and is time consuming to remedy.

It is an object of the present invention to provide an improved vertical coil lifter that addresses the above described problem and is an improvement, or at least a useful alternative, to lifters of the prior art.

SUMMARY OF THE INVENTION

According to a first aspect of the present invention there is provided a vertical bore coil lifter including:

at least one inner support for the inner wraps of a coil; and at least one outer support for the outer wraps of the coil;

wherein the lifter includes a linkage between the at least one inner support and the at least one outer support arranged to selectively bring said inner support and said outer support toward each other or away from each other for lifting and releasing of the coil.

In one embodiment the linkage is arranged to bring said inner support and said outer support away from each other in response to a lifting force applied at one or more first predetermined locations on the lifter.

In said embodiment the linkage is further arranged to bring said inner support and said outer support away from each other in response to a lifting force applied at a second predetermined location on the lifter.

Preferably the inner support comprises a foot at a remote end of an inner leg for traversing the bore; and the outer support comprises a foot at a remote end of an outer leg for traversing outside the coil; wherein opposite ends of the inner leg and the outer leg are pivotally connected.

In one embodiment the at least one inner support comprises first and second inner feet and the at least one outer support comprises first and second outer feet.

Preferably the first inner foot and the first outer foot are opposed. Similarly, preferably the second inner foot and the second outer foot are opposed.

Preferably the first outer leg and the first inner leg are pivotally connected by a first lifting pivot. Preferably the first lifting pivot comprises one of said one or more first predetermined locations on the lifter In one embodiment the second outer leg and the second inner leg are pivotally connected by a second lifting pivot. Preferably the second lifting pivot comprises of further one of said one or more first predetermined locations on the lifter Preferably the first inner leg and the second inner leg are pivotally connected by a release pivot. Preferably the release pivot comprises the second predetermined location on the lifter.

In one embodiment the first lifting pivot is laterally distanced from the first outer leg and the first inner leg.

Similarly, it is preferred that the second lifting pivot is laterally distanced from the second outer leg and the second inner leg.

Furthermore, it is preferable that the release pivot is laterally spaced from the first inner leg and from the second inner leg.

Preferably at least one adjustment assembly is provided to selectively vary the distance between at least one inner and outer pair of said legs.

In the preferred embodiment the linkage includes a first member pivotally connected at either end between the first outer leg and the second inner leg.

Preferably the linkage also includes a second member pivotally connected at either end between the second outer leg and the first inner leg.

In the preferred embodiment first and second lifting shackles are connected to the first and second lifting pivots for engagement of lifting lines.

In the preferred embodiment a release shackle is connected to the release pivot for engagement of a release line.

In a further embodiment a user actuated assembly is provided for selecting between the release configuration and the open configuration.

In a preferred embodiment of the invention an automatic latching/unlatching mechanism is provided that is arranged to automatically alternate the lifter from the release to the closed configuration and vice-versa in response to tensioning and release of a lifting line coupled to said mechanism.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings. Throughout the drawings common identifier numbers are used to refer to like features that are common between the various embodiments of the invention described herein. The drawings are as follows.

DETAILED DESCRIPTION OF PREFERRED EMBODIMENTS

Figure 1:
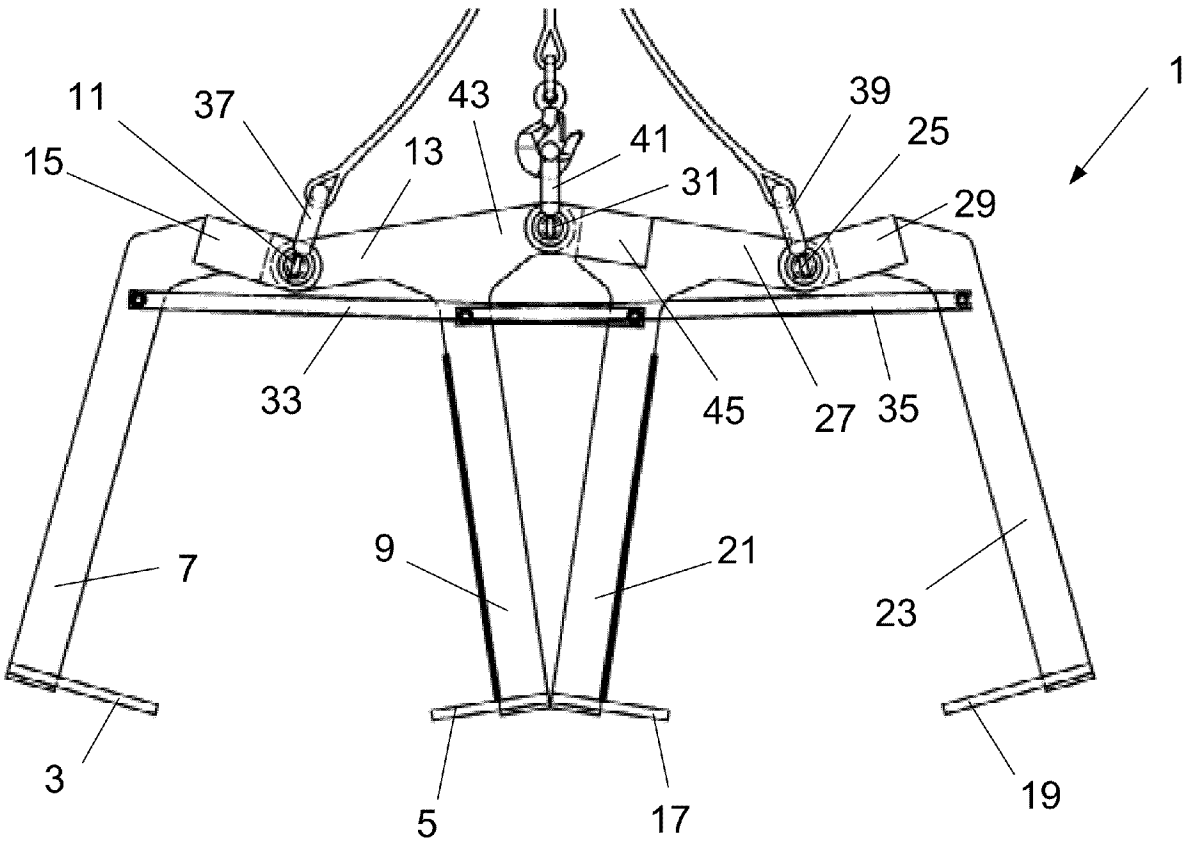
FIG. 1 depicts a lifting apparatus, i.e. a lifter, according to a first embodiment of the present invention in a first, coil release, configuration.

Referring now to FIG. 1, there is depicted a vertical bore coil lifter 1 according to a first embodiment of the invention.

The lifter 1 includes load supports in the form of first outer foot 3, first inner foot 5, second inner foot 17 and second outer foot 19. The feet are each located at the ends of first outer leg 7, first inner leg 9, second inner leg 21 and second outer leg 23 respectively.

The first outer leg 7 and the first inner leg 9 are interconnected by a first lifting pivot 11 which is laterally spaced therebetween by lateral portions 15 and 13 of said legs 7 and 9. In similar fashion, the second outer leg 23 and the second inner leg 21 are interconnected by a second lifting pivot 25 which is laterally spaced therebetween by lateral portions 27 and 29 of said legs 21 and 23.

The first and second inner legs 9 and 21 are pivotally connected by a release pivot 31 which is laterally spaced therebetween by lateral portions 43 and 45 of said legs.

First and second lifting shackles 37 and 39 are connected to lifting pivots 11 and 25. Similarly a release shackle 41 is connected to release pivot 31. It will be realised that the inner and outer supports, i.e. feet 5, 17 and 3, 19 are interlinked by a linkage including their respective legs and the pivots 11, 31, 25.

The linkage further includes a first member 33 pivotally connected at either end between upper portions of first outer leg 7 and second inner leg 21. The linkage also includes a second member 35 pivotally connected at either end between upper portions of second outer leg 23 and first inner leg 9.

While it is preferred that compression members, in the form of the elongate, rigid, rod-like members 33, 35 be used, tension members, such as cables with suitable pulleys might be used in some embodiments of the invention.

Figure 2:
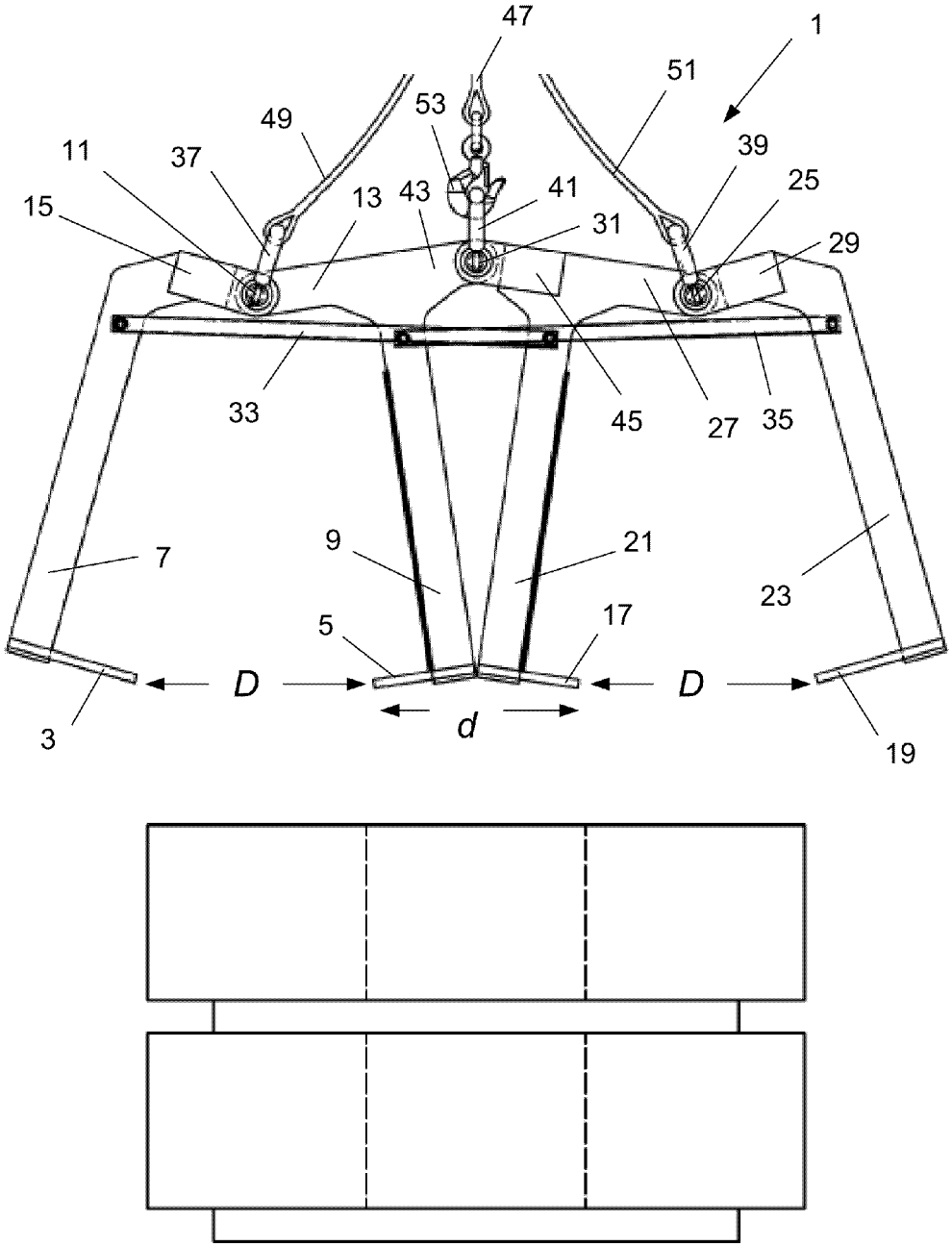
FIGS. 2 to 4 depict the lifting apparatus of FIG. 1 in the coil release configuration being lowered onto a coil for lifting.
Figure 4:
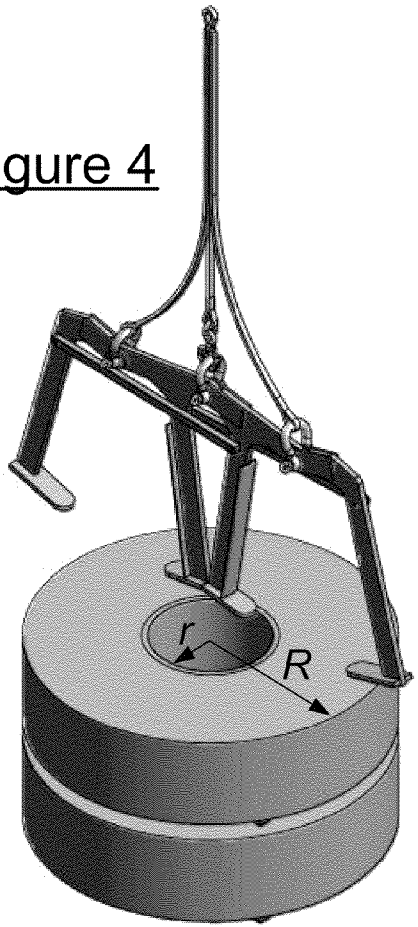
Figure 3:
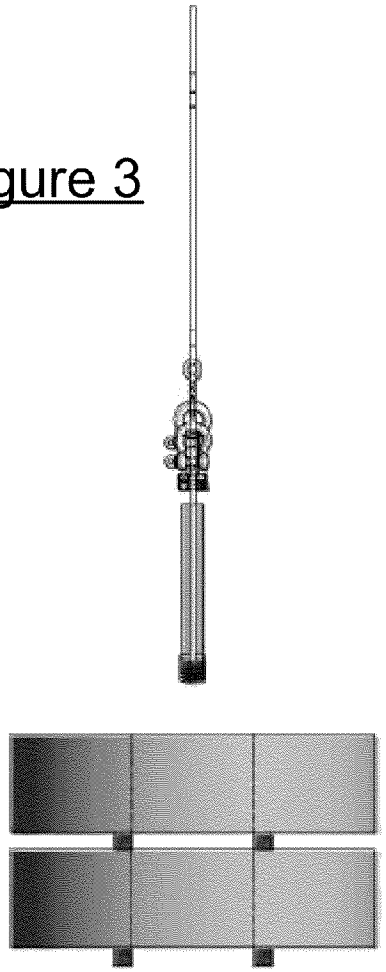

Referring now to FIGS. 2 to 4, in use a release line 47 is provided that terminates in a hook 53 for attachment to release shackle 41. As the lifting assembly 1 is raised the line 47 is tensed and raises release pivot 41. In response the lower ends of the first and second inner legs 9 and 21 pivot, under the force of gravity towards each other as shown in FIG. 2. As the second inner leg 21 pivots inward it forces first outer leg 7 to pivot outward about first lifting pivot 11 by means of member 33. Similarly, as the first inner leg pivots inward, it forces the second outer leg 23 to pivot outward about second lifting pivot 25 by means of second member 35.

It will be realised that in order for the above described opening of the legs to occur in response to tensioning of release line 47, the moment on first inner leg 9, about release pivot 31 must exceed the moment on the second outer leg 23 about second lifting pivot 25. Similarly, the moment on the second inner leg 21 about release pivot 31 must exceed the moment on the first outer leg about first lifting pivot 11. The magnitude of these moments is a function of the weight of the legs and the length of the lateral portions, 15, 13, 43, 45, 29 that offset the centre of gravity for each leg from its associated pivots.

Furthermore, the positioning of the end points of the members 33, 35 that span between the inner and outer legs will also alter the magnitude of the moments and must be taken into account to ensure that the legs open and close as desired in response to tensioning of line 47 or lines 49, 51. Consequently, it will be realised that the version of the lifting apparatus shown in the figures is simply one embodiment and that numerous other embodiments within the scope of the invention are possible and encompassed.

In the release configuration, shown in FIGS. 2 to 4, the respective inner feet 5, 17 and outer feet 3, 19 are drawn apart so that there is sufficient space D between them to accommodate the distance (R-r), being the difference of the outer diameter of the coil and the diameter of the bore. Furthermore the length back to back of both of the inner feet d , as shown in FIG. 2 is less than the diameter of the bore 2*r* so that the inner feet can be received within the bore in the release configuration. In the release configuration shown in FIGS. 2 to 4 the lifting apparatus 1 is lowered so that the inner legs 9, 21 penetrate the bore until the feet 3, 5, 17, 19 are a little below the level of underside of the coil to be lifted. The lifting lines 51 and 49 are then placed under tension, for example by an overhead crane, and hook 53 is disconnected from lifting shackle 41 thereby disconnecting release line 47. It will be realised that disconnecting release line 47 selects the lifting configuration for the lifter.

Figure 7:
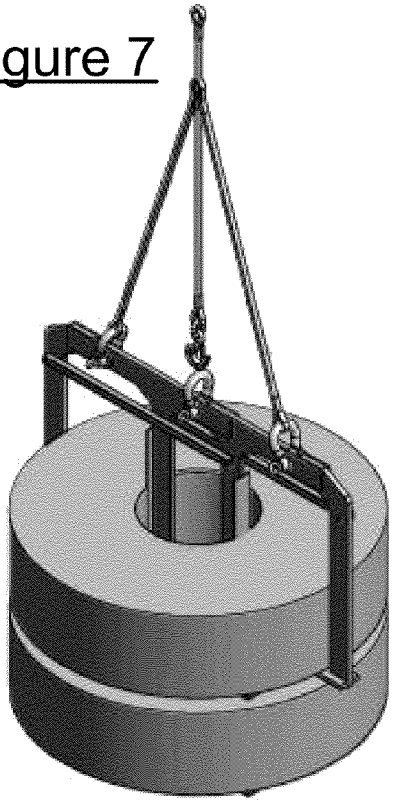
FIGS. 5 to 7 depict the lifting apparatus of FIG. 1 in a coil lift configuration.
Figure 6:
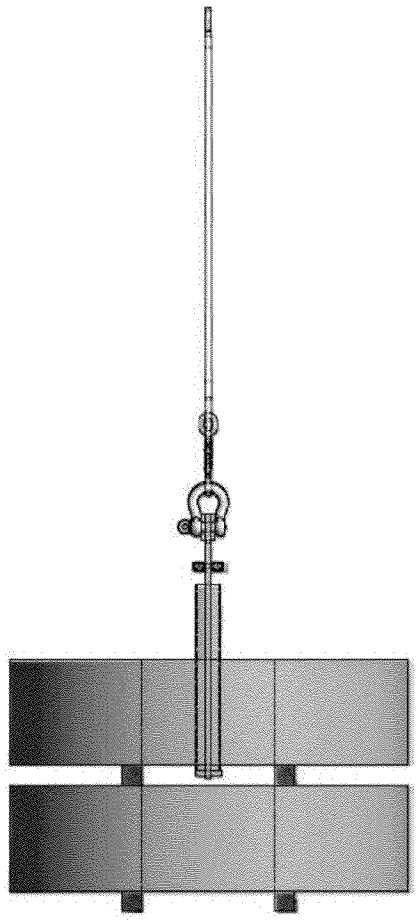
Figure 5:
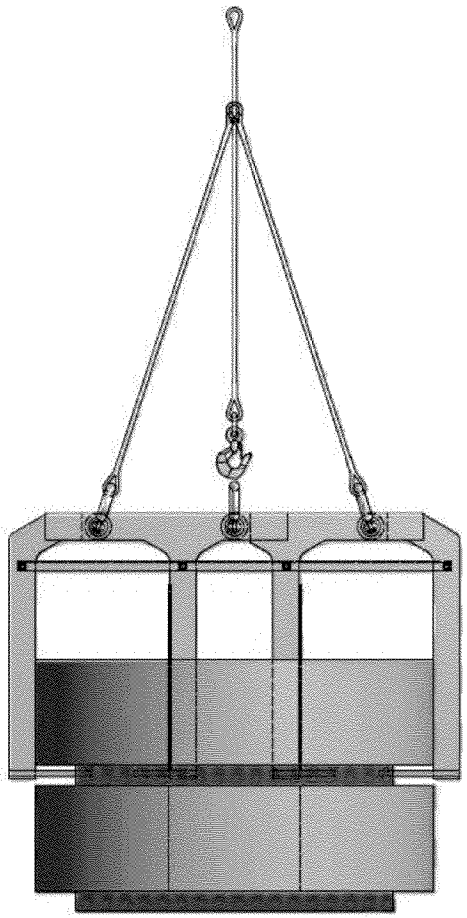

Consequently, as further tension is applied to lifting lines 51 and 49 the respective inner and outer feet are brought together beneath the coil as shown in FIGS. 5 to 7 to assume the coil lift configuration shown therein. It will be noted from FIG. 5 that the inner and outer feet span most of the wraps of the coil and furthermore that the outer arms are located vertically about the sides of the coil. As a result, the likelihood of telescoping of the coil occurring during lifting is greatly reduced.

While it is preferable that the lifter 1 includes first and second pairs of inner and outer legs, in a considerably less preferred embodiment only the first pair of inner and outer legs and hence only one lifting pivot, may be incorporated. Such an embodiment would only lift one side of the coil and so, while encompassed by the invention, is far less preferred.

Furthermore, while it is preferred that the first and second lifting shackles and the release shackle are fastened to the first and second lifting pivots and release pivot respectively, they might instead be fastened to portions of the various legs in other embodiments of the invention.

In the previously discussed embodiment a mechanical linkage, members 33 and 35, was provided between the inner and outer legs so that all four legs open and close in unison. The hook 53 on the central chain 47 is coupled to the central hook eye 31 to open the mechanism and uncoupled to close it. This manual hook coupling/de-coupling requires reaching over a 1500 mm coil. It would be desirable if this requirement could be overcome.

Figure 8:
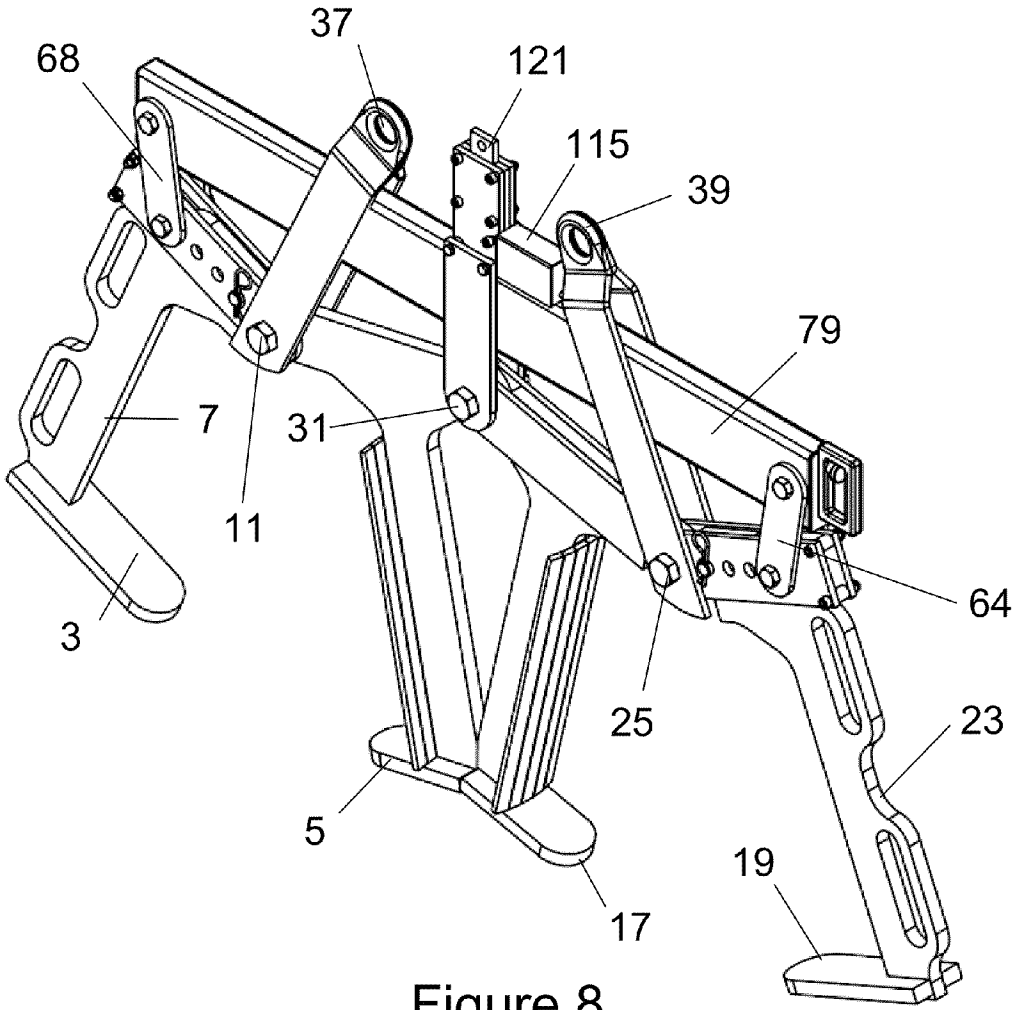
FIG. 8 depicts a second embodiment of the invention which includes a user operated configuration selection operator button.
Figure 9:
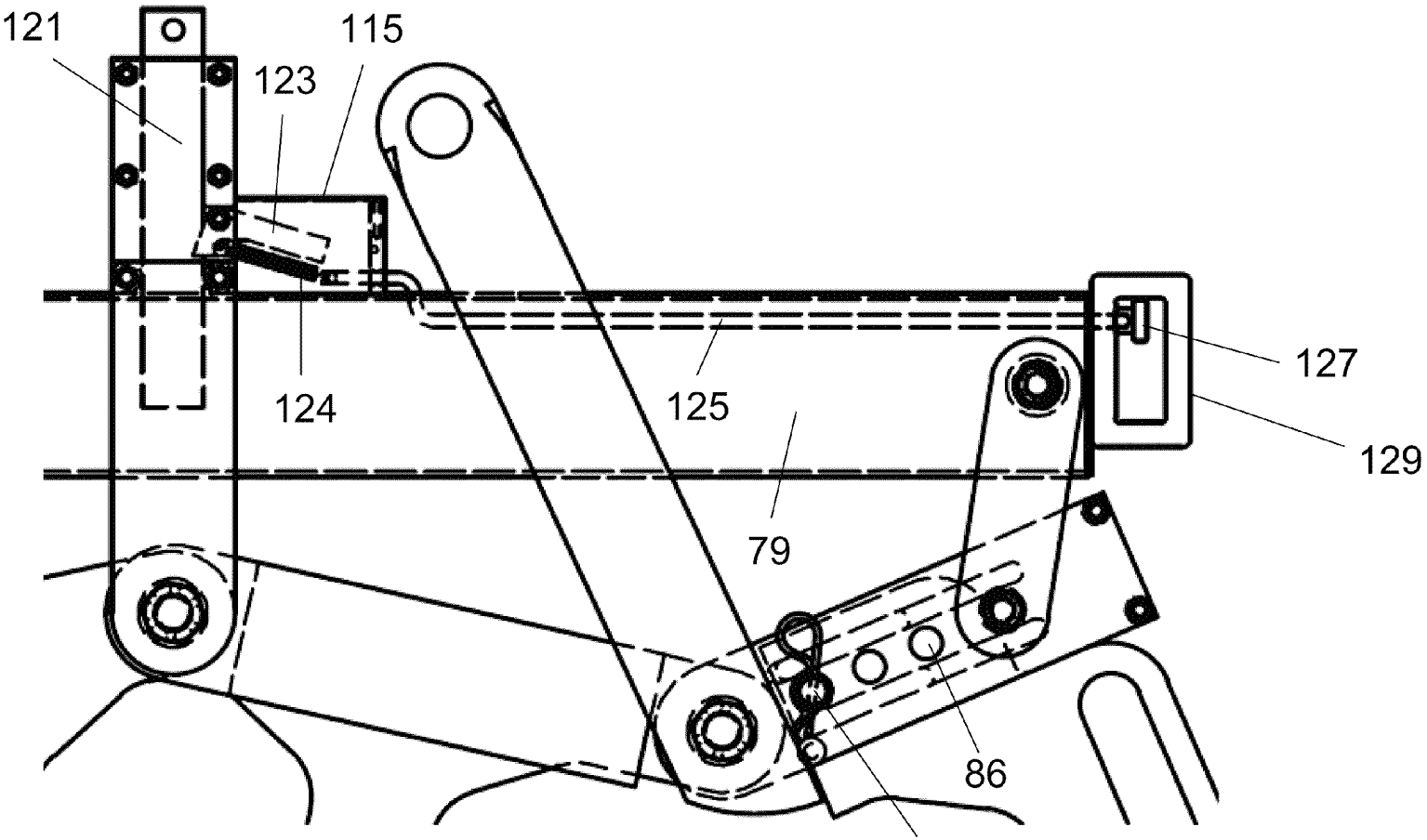
FIG. 9 is a closeup of a portion of the embodiment of FIG. 8 revealing internal features.
Figure 10:
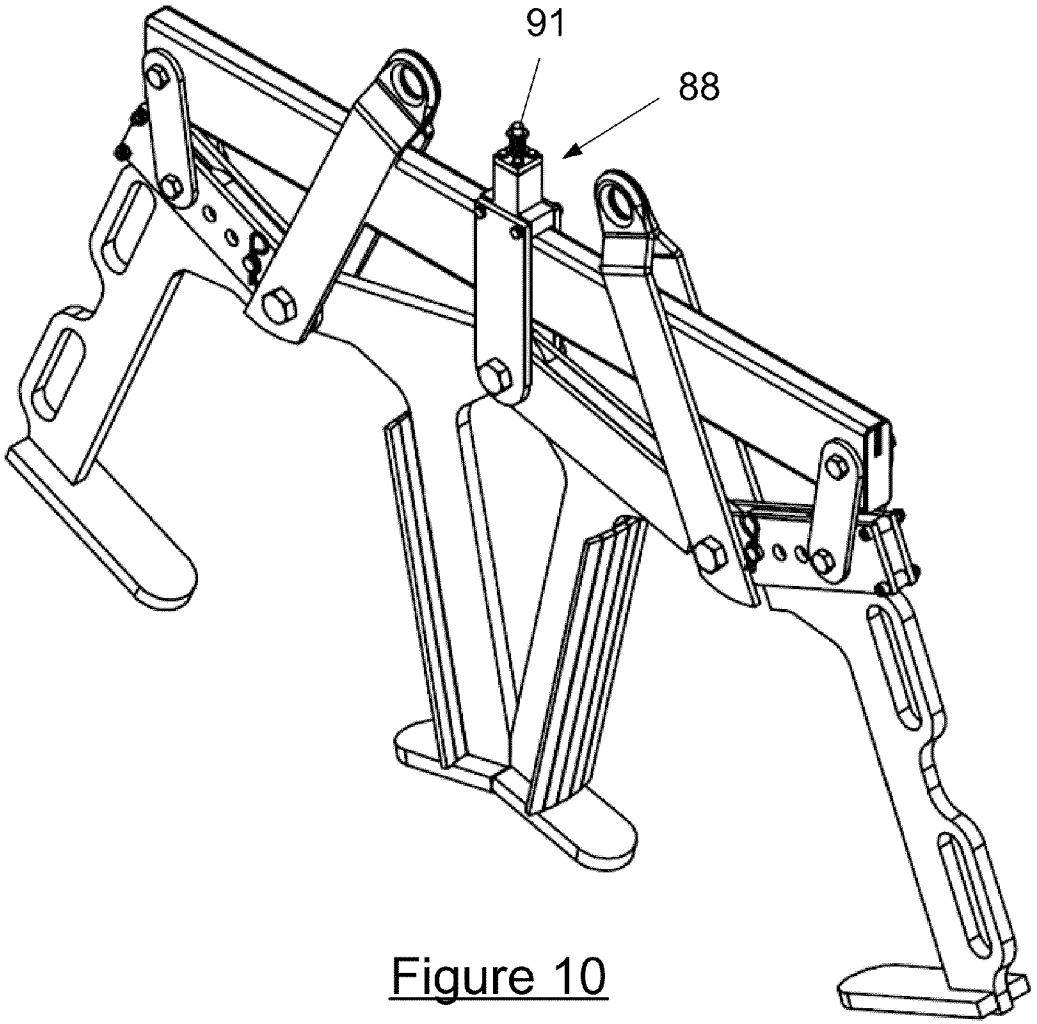
FIG. 10 depicts a preferred embodiment of the present invention which is configured to automatically alternate between open and release configurations.
Figure 11:
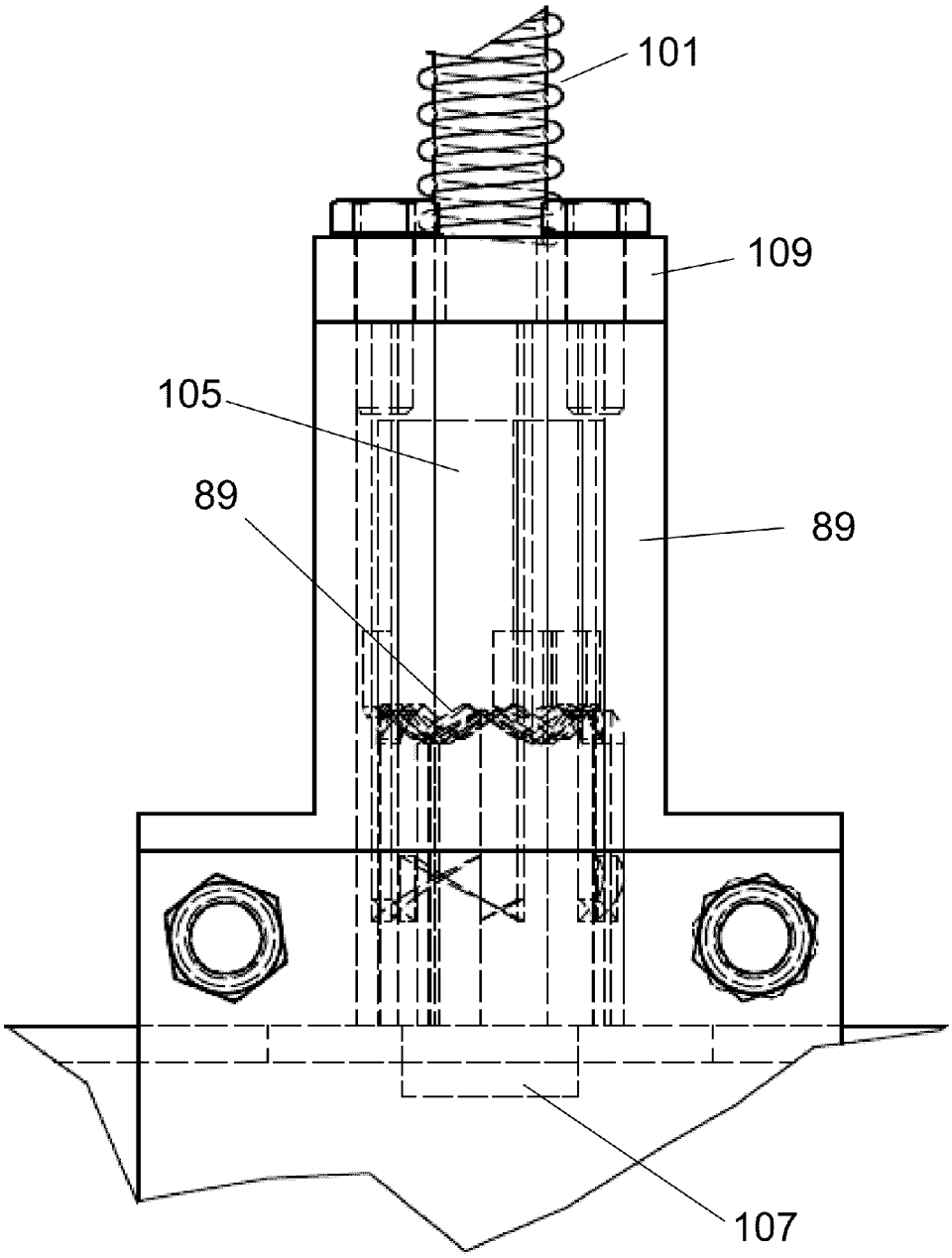
FIG. 11 is a close up of a portion of the embodiment of FIG. 10 revealing internal features.
Figure 12:
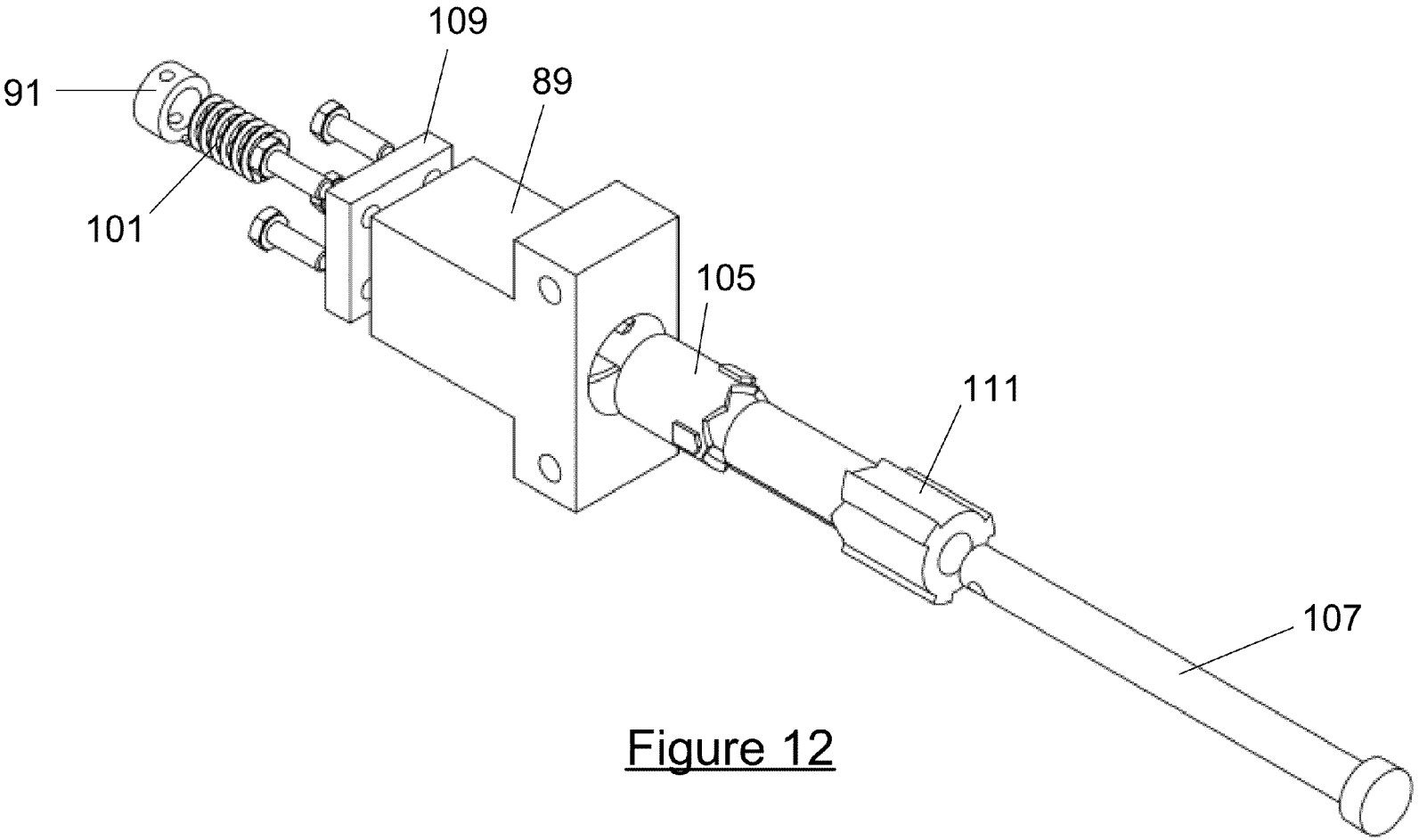
FIG. 12 is an isometric exploded assembly drawing of the mechanism of FIG. 11.
Figure 13:
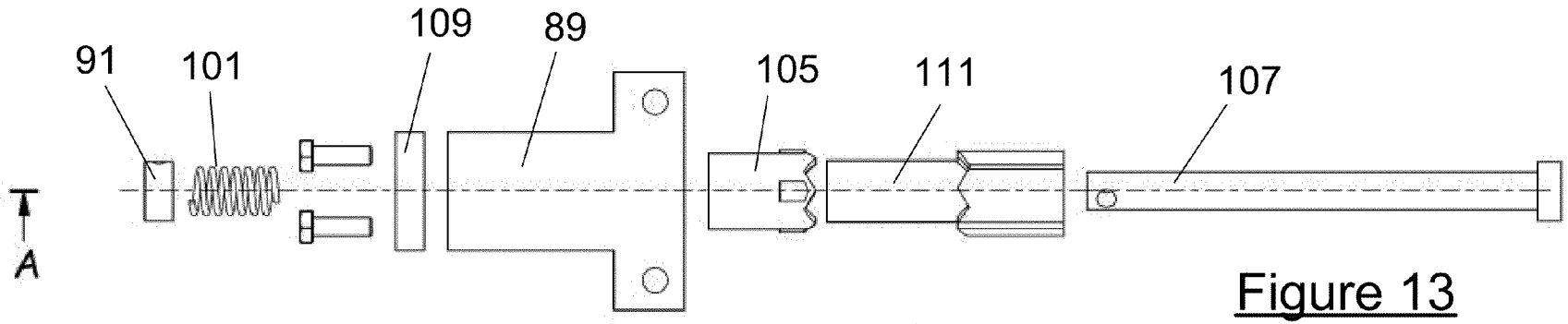
FIG. 13 is a side elevation of the mechanism of FIG. 12.
Figure 14:
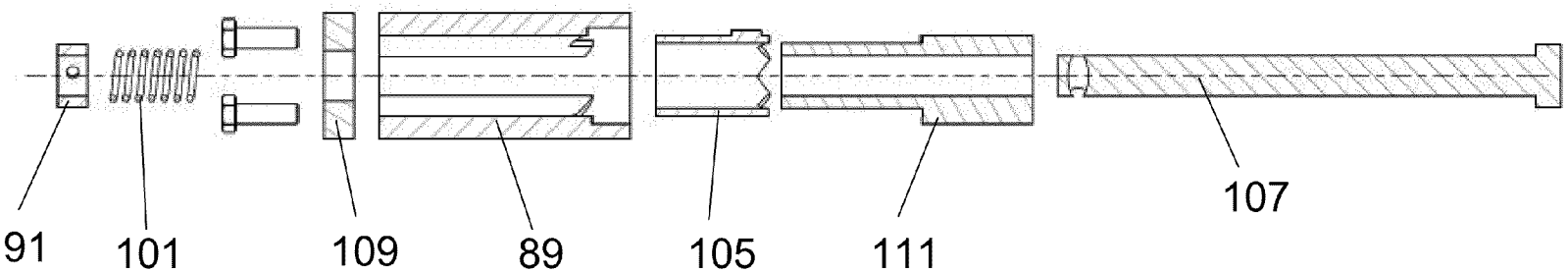
FIG. 14 is a cross sectional view of the mechanism of FIG. 12.

FIGS. 8 and 9 depict a further embodiment of the invention that does not include members 33 and 35 of the embodiment of FIG. 1. Rather, in the embodiment of FIG. 8*a* crossbar 79 is provided that spans across the four legs and which is pivotally coupled at either of its ends by plates 68 and 64 to outer upper ends of legs 7 and 23.

A lifting point in the form of a notched plate 121 is provided above cross bar 79 that as will be explained is arranged to be selectively coupled and uncoupled to the cross bar. When the lifting point 121 is coupled to cross bar 79 a line fastened to the lifting point 121 and raising it will in turn lift cross bar 79 and so plates 68 and 64 thereby causing the feet to open.

Alternatively, when the lifting point 121 is decoupled to cross bar 79 then it will pull upon middle pivot point 31 thereby causing the feet 3, 5 and 17, 19 to close.

With reference to FIG. 9, the coupling decoupling mechanism comprises a very lightly detented push button 127 that is arranged to open/close pawl 123 via a pushrod 125 thereby eliminating the need to for an operator reach over a large coil of steel to reconfigure the lifter.

In addition to the basic pushbutton operation, it is also possible to pre-trigger both the opening and closing of the mechanism. This is achieved by a combination of the detented pushbutton item 127 and associated push-rod 125 which is biased by spring 124, the pawl 123 and notched plate 121.

As an example of pre-closing the mechanism, assume the position of the aforementioned components are as shown in FIG. 9, which is a partial view of the lifter in the open configuration. In this configuration, the entire weight of the quad hook is supported by the line which is connected to the notched plate 121. As a consequence, the pawl 123 is held captive and cannot be disengaged. The detented pushbutton 127 and associated push-rod item 125 can be pulled to the right which simply stretches the tension spring attached to the left end of the push-rod 125. The spring 124 is very light duty and is not sufficient to overcome the detented pushbutton 127 so the mechanism opening/closing status remains unchanged. However, when the mechanism is lowered over a coil and pressure is removed from the notched plate item 121, the spring force pulls the pawl item 123 out of mesh with the notched plate 121 so that the feet close when raised by the lifting crane.

Conversely, after the coil is raised, the pushbutton 127 can be pre-triggered to release the coil when pressure is removed from the chains A large side handle 129 is provided to allow the operator to safely guide the lifter when placing or removing coils on top of coils. Vertical bore coil stacking is common within the coil handling industry and low side handles aids safer coil handling Referring again to FIG. 9, the distance between the inner and outer legs may be varied to cater for an array of coil sizes.

Coil storage space is often at a premium and this further embodiment aids in maximising small coil density storage since it allows for the handling of small diameter coils. Adjustment is via a pin 85 that can be inserted through one of a number of spaced holes 86 to vary the inter-leg distance. An R clip is provided to retain the pin in place. Adjustment is made in the closed condition (legs vertical), as this eliminates inclined forces due to gravity.

A further and preferred embodiment of the invention will now be described with reference to FIGS. 10 to 14. In this embodiment an automatic latching/unlatching mechanism 88 is provided that replaces the previously described detented push button operated mechanism. The automatic mechanism 89 is arranged so that the lifter is automatically changed from open to closed configuration and vice-versa with every hook placement (chain tension-release).

With reference to FIGS. 11 to 14, the auto latch/unlatch mechanism 88 can be broken into one dynamic sub assembly and one static sub assembly. The static sub assembly consists of the housing 89 and housing cap 109. The dynamic sub assembly consists of a central shaft Item 107, on which sits a rotating ratchet item 111. A sliding ratchet 105 sits on top of the rotating ratchet 111 and a spring 101 then sits on the sliding ratchet 105. A spring collar 91 sits on top of the spring 101 and applies a very light force to axially constrain all dynamic parts.

The spring assembly is arranged so that it only applies light pressure to hold the rotating ratchet 111 in mesh with the sliding ratchet 105. The complete dynamic sub assembly is able to move a significant vertical distance within the static sub assembly to allow the ratchet mechanism in the bore of the housing 89 to disengage completely from the rotating ratchet 111 and is limited by the spring collar 91. Every chain release allows the rotating ratchet 111 to turn 1/12th of a turn and corresponding chain tension allows a further 1/12th of a turn in the same direction. Therefore every 1/3rd of a turn, the mechanism changes from latched to unlatched.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

What is claimed:

1. A vertical bore coil lifter including:

at least one inner support for the inner wraps of a coil;

at least one outer support for the outer wraps of the coil; and the inner support further comprising first and second inner legs, each leg having a foot at a remote end of said inner leg for traversing the vertical bore in the coil and adapted to extend under the coil when the coil is lifted;

the outer support further comprising first and second outer legs, each leg having a foot at a remote end of said outer leg for traversing outside the coil and adapted to extend under the coil when the coil is lifted;

the first outer leg and the first inner leg being pivotally connected by a first lifting pivot;

the second outer leg and the second inner leg being pivotally connected by a second lifting pivot;

the first inner leg and the second inner leg being pivotally connected by a release pivot;

the lifting pivots comprising one or more first predetermined locations on the lifter; and a linkage between the at least one inner support and the at least one outer support arranged to selectively bring said inner support and said outer support toward each other for a closed configuration or away from each other for an open configuration for lifting and releasing of the coil, wherein the linkage is arranged to bring said inner support and said outer support away from each other in response to a lifting force applied at one or more first predetermined locations on the lifter.

2. A lifter according to claim 1, wherein the linkage is further arranged to bring said inner support and said outer support away from each other in response to a lifting force applied at a second predetermined location on the lifter.

3. A lifter according to claim 1, wherein the first inner foot and the first outer foot are opposed.

4. A lifter according to claim 3, wherein the second inner foot and the second outer foot are opposed.

5. A lifter according to claim 1, wherein the release pivot comprises the second predetermined location on the lifter.

6. A lifter according to claim 5, wherein the first lifting pivot is laterally distanced from the first outer leg and the first inner leg.

7. A lifter according to claim 6, wherein the second lifting pivot is laterally distanced from the second outer leg and the second inner leg.

8. A lifter according to claim 7, wherein the release pivot is laterally spaced from the first inner leg and from the second inner leg.

9. A lifter according to claim 8, including at least one adjustment assembly arranged to selectively vary the distance between at least one inner and outer pair of said legs.

10. A lifter according to claim 9, including a first member pivotally connected at either end between the first outer leg and the second inner leg.

11. A lifter according to claim 10, wherein the linkage also includes a second member pivotally connected at either end between the second outer leg and the first inner leg.

12. A lifter according to claim 1 including a user actuated assembly arranged for a user to select between the release configuration and the closed configuration.

13. A lifter according to claim 1, including an automatic latching/unlatching mechanism arranged to automatically alternate the lifter from the release to the closed configuration and vice-versa in response to tensioning and release of a lifting line coupled to said mechanism.

* * * * *